US010895115B2

(12) United States Patent
Rodriguez et al.

(10) Patent No.: US 10,895,115 B2
(45) Date of Patent: Jan. 19, 2021

(54) RIG STRUCTURE AND RIG-UP PROCESS

(71) Applicant: Schlumberger Technology Corporation, Sugar Land, TX (US)

(72) Inventors: Gustavo E. Rodriguez, Spring, TX (US); Mark W. Trevithick, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 88 days.

(21) Appl. No.: 16/103,543

(22) Filed: Aug. 14, 2018

(65) Prior Publication Data

US 2019/0048665 A1 Feb. 14, 2019

Related U.S. Application Data

(60) Provisional application No. 62/545,182, filed on Aug. 14, 2017.

(51) Int. Cl.

| | |
|---|---|
| ***E21B 17/02*** | (2006.01) |
| ***E21B 15/00*** | (2006.01) |
| ***E21B 7/02*** | (2006.01) |
| *E04H 12/34* | (2006.01) |
| *E04H 12/18* | (2006.01) |

(52) U.S. Cl.

CPC ..... *E21B 15/003* (2013.01); *E21B 7/02* (2013.01); *E04H 12/18* (2013.01); *E04H 12/345* (2013.01)

(58) Field of Classification Search

CPC ..... E21B 15/003; E21B 17/02; E21B 7/02

See application file for complete search history.

(56) References Cited

U.S. PATENT DOCUMENTS

| | | | | |
|---|---|---|---|---|
| 7,765,749 | B2 | 8/2010 | Palidis | |
| 7,828,087 | B2 | 11/2010 | Vora | |
| 8,250,816 | B2 | 8/2012 | Donnally et al. | |
| 8,549,815 | B2 | 10/2013 | Donnally et al. | |
| 9,169,698 | B2 | 10/2015 | Wijning et al. | |
| 9,249,626 | B2 | 2/2016 | Flusche | |
| 9,945,146 | B2 | 4/2018 | Robb | |
| 2016/0010323 | A1* | 1/2016 | Konduc | E21B 7/02 52/69 |
| 2017/0321490 | A1 | 11/2017 | Haavind | |
| 2018/0086399 | A1 | 3/2018 | Smith et al. | |

* cited by examiner

*Primary Examiner* — Tara Schimpf
(74) *Attorney, Agent, or Firm* — Jeffrey D. Frantz

(57) ABSTRACT

A rig system includes a first base box and a second base box extending parallel to and offset from the first base box, such that an open space is defined therebetween. A rig floor is connected to the first and second base boxes and spans the open space. A mast is coupled to the rig floor. A rig-raising system is configured to raise the rig floor vertically above the ground. A combined local equipment room (LER) and drilling control room (DCR) skid is connected to the rig floor and configured to be raised with the rig floor. A reel skid is positioned at least partially vertically below the LER/DCR skid. A setback structure extends between the first and second base boxes and blocks the open space on at least one end.

19 Claims, 15 Drawing Sheets

RIG STRUCTURE AND RIG-UP PROCESS

CROSS-REFERENCE TO RELATED APPLICATIONS

This application claims priority to U.S. Provisional Patent Application No. 62/545,182, filed on Aug. 14, 2017, which is incorporated by reference herein.

BACKGROUND

Oil rigs can be designed to facilitate their transport from one well location to another. For example, land-based oil rigs may be made of several sub-components that are sized to fit onto trailers and travel on roads from wellsite to wellsite. When received at a wellsite, the sub-components are assembled together as part of a "rig-up" sequence, ending with the rig ready to drill.

Such transportable rig sub-components often include a substructure, a rig floor, and a mast, among others, which may themselves be disassembled into smaller components. For example, the substructure may include a pair of base boxes, connected together by a spreader. The rig floor is supported by the base boxes, and the mast is supported by the rig floor. Rig-up sequences can include attaching the mast to the rig floor, and raising the mast from a horizontal orientation to a vertical orientation. Before or after raising the mast, the rig floor is lifted upwards on the substructure (e.g., by expanding the base boxes), providing room for a cellar around and immediately above the wellhead.

Rigs also provide a setback, where the lower ends of stands of tubulars (e.g., drill pipe) are supported when in the rack. The setback is often on the rig floor, and thus elevated therewith and clear of the substructure. However, in some applications, the setback may be positioned on the ground, e.g., at the spreader. In these cases, the positioning of the setback can create an obstacle during the assembly of the various components during the rig-up sequence, and potentially may interfere with wellheads during rig-walking.

SUMMARY

Embodiments of the disclosure may provide a method for assembling a drilling rig. The method includes positioning a first base box of a substructure and a second base box of the substructure, such that the first and second base boxes are separated apart from one another by an open space, connecting a rig floor between the first and second base boxes, connecting a mast section to the rig floor, after connecting the mast section to the rig floor, connecting a setback structure between the first and second base boxes, and raising the rig floor such that the rig floor is vertically above the ground, wherein the setback structure is not raised with the rig floor.

Embodiments of the disclosure may also provide a rig system including a first base box, a second base box extending parallel to and offset from the first base box, such that an open space is defined therebetween, a rig floor connected to the first and second base boxes and spanning the open space, a mast coupled to the rig floor, a rig-raising system configured to raise the rig floor vertically above the ground, a first skid connected to the rig floor and configured to be raised with the rig floor, a second skid positioned at least partially vertically below the first skid, and a setback structure extending between the first and second base boxes and blocking the open space on at least one end.

Embodiments of the disclosure may further provide a rig system including a first base box, a second base box extending parallel to and offset from the first base box, such that an open space is defined therebetween, a rig floor connected to the first and second base boxes and spanning the open space, and a mast coupled to the rig floor. The mast includes a lower section and an upper section that are connected together, a rig-raising system configured to raise the rig floor vertically above the ground. The system also includes a combined local equipment room (LER) and drilling control room (DCR) skid connected to the rig floor and configured to be raised with the rig floor. The LER/DCR skid includes one or more variable frequency drives and a driller's cabin. The system further includes a reel skid positioned at least partially vertically below the LER and DCR skid. The reel skid includes one or more control cable reels, one or more power cable reels, or both, and the LER and DCR skid and the reel skid extend parallel to one another. The system also includes a setback structure extending between the first and second base boxes and blocking the open space on at least one end. The setback structure includes a first end section connected to the first base box, a second end section connected to the second base box, and a clearance panel connected to the first and second end sections. The clearance panel is configured to be movable to allow for the setback structure to move past well equipment. Further, the clearance panel is removable from the first and second end sections. The setback structure includes a top bar that is rigidly connected to the first and second end sections both when the clearance panel is attached to the first and second end sections and when the clearance panel is removed therefrom.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
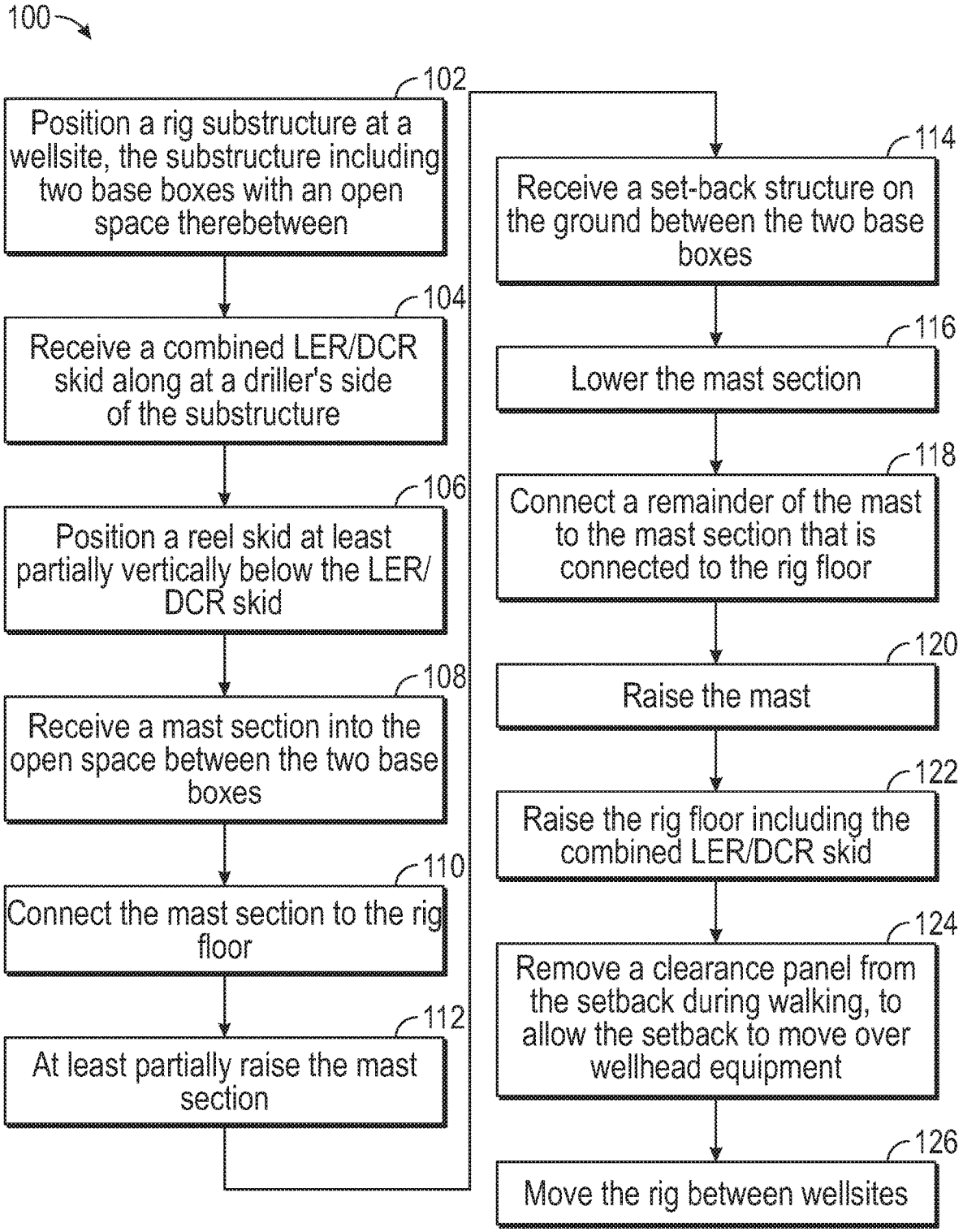
FIG. 1 illustrates a flowchart of a method for assembling a drilling rig, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a flowchart of a method 100 for assembling a drilling rig, according to an embodiment. The method 100 may be executed in order to assemble any type of drilling rig, and thus should not be considered to require any particular structure, unless otherwise stated herein. For ease of understanding, however, the method 100 will be described herein with reference to an illustrative drilling rig shown in the Figures, but this rig is intended merely as an example.

Figure 2:
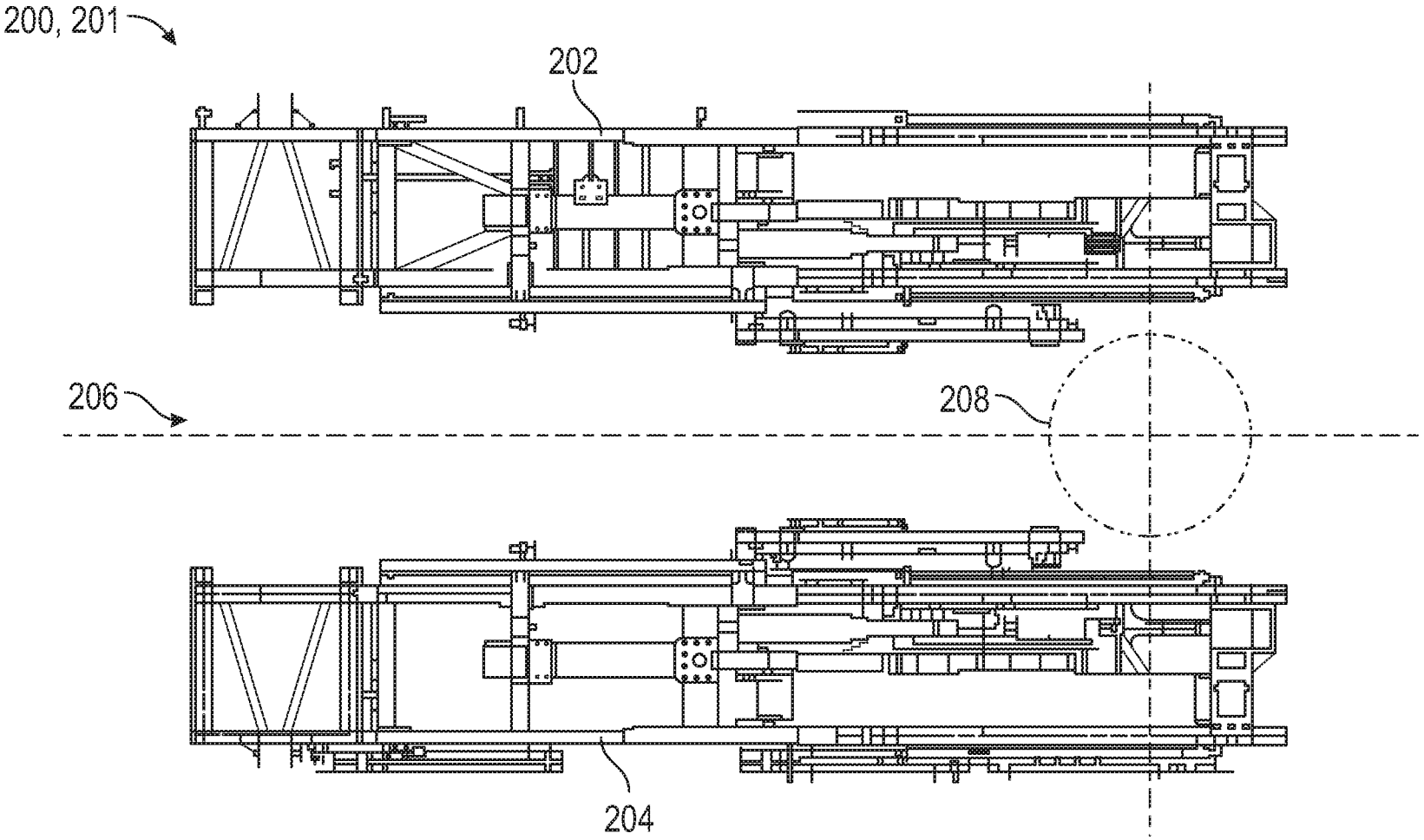
FIG. 2 illustrates plan view of two base boxes of a substructure, according to an embodiment.

Beginning at 102, the method 100 may include positioning at least a portion of a rig substructure of the drilling rig at a wellsite. The substructure includes two base boxes with an open space therebetween. FIG. 2 illustrates a plan view of part of a drilling rig 200 as it is being assembled, according to an embodiment. The drilling rig 200 includes a rig substructure 201, which is partially constructed in FIG. 2. As indicated in FIG. 2, the rig substructure 201 at this stage includes two base boxes 202, 204 which are generally rectangular and extend parallel to one another. The base boxes 202, 204 may be expandable, e.g., through an arc, so as to allow for a rig floor to be raised upwards, vertically away from the ground, as will be described in greater detail below.

Figure 3:
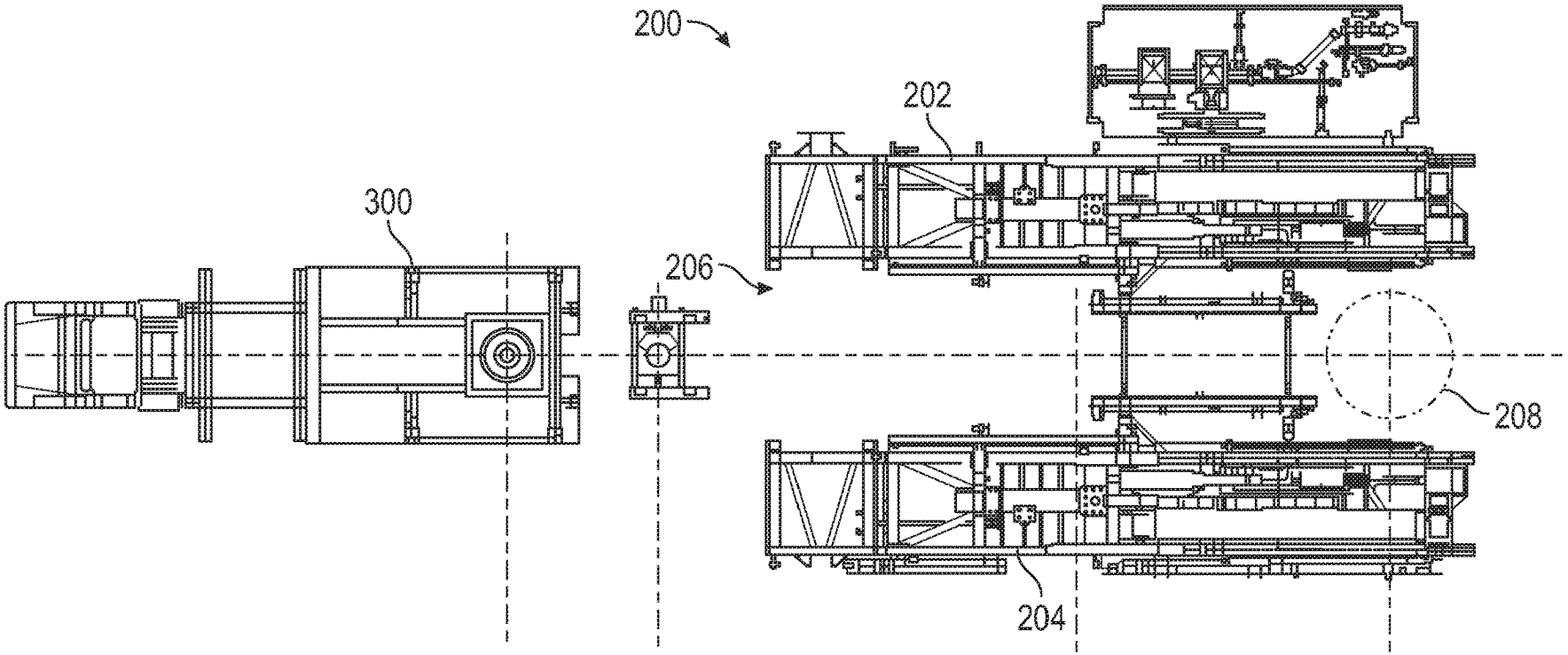
FIG. 3 illustrates plan view of a rig floor being connected to the base boxes, according to an embodiment.
Figure 4:
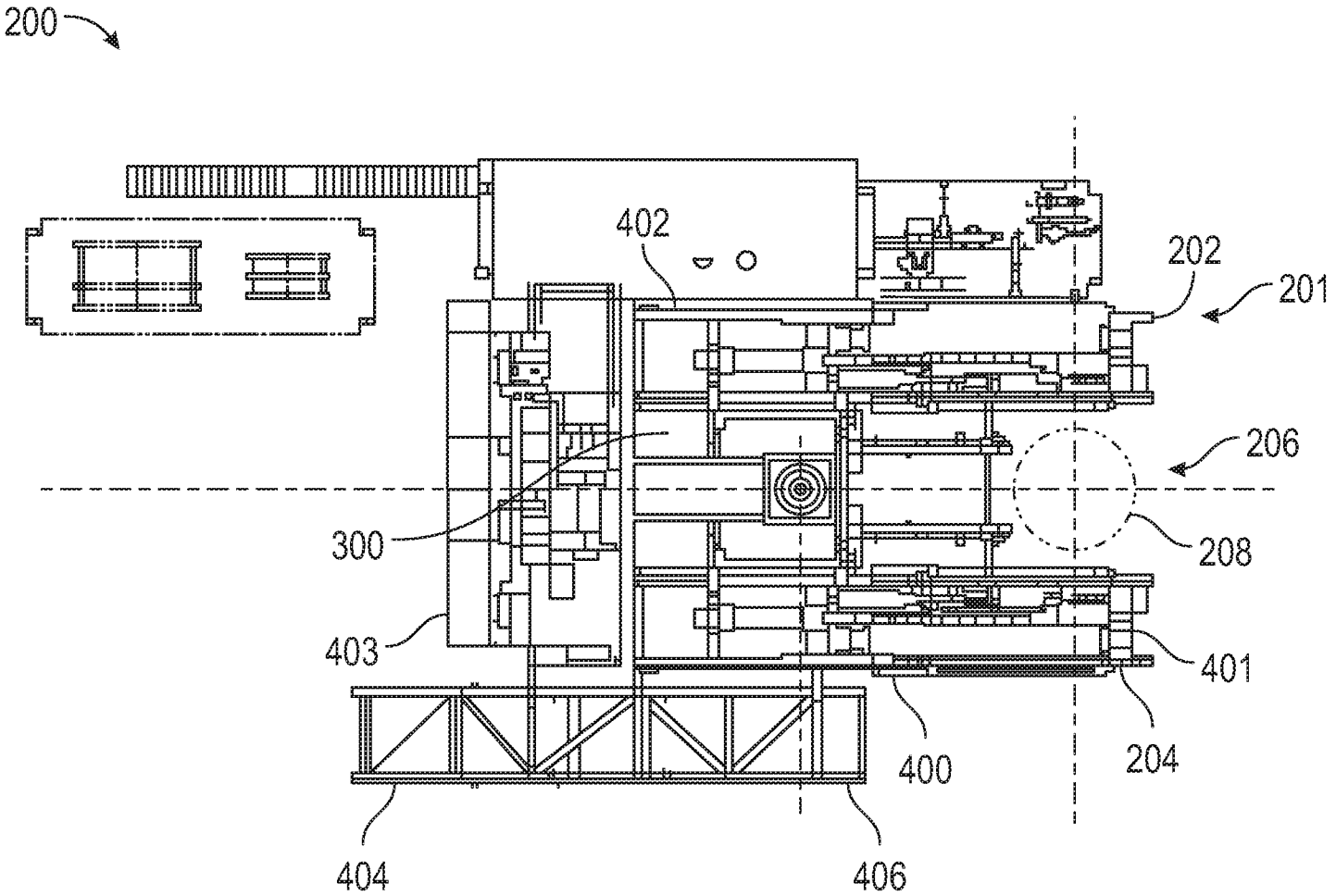
FIG. 4 illustrates plan view of the rig being connected to a combined skid frame, according to an embodiment.

The base boxes 202, 204 are offset from one another, thus defining an open space 206 therebetween. The wellsite 208 (e.g., where a well has at least partially been drilled or is planned to be drilled) is located between the base boxes 202, 204, in the open space 206. As shown in FIG. 3, a central package, including a drilling rig floor 300, may be assembled between the two base boxes 202, 204, e.g., by receiving a truck and/or a trailer therebetween. The rig floor 300 may be raised by expanding the base boxes 202, 204.

Returning to FIG. 1, the method 100 may include receiving a combined local equipment (or electric) room (LER) and driller's control room (DCR) skid along a driller's side of the substructure, as at 104. The LER/DCR skid may include one or more variable frequency drives, transformers, etc., e.g., for controlling the power of the drawworks, top drive, and other components of the rig. The LER/DCR skid may also include a driller's cabin, where an operator may be stationed and able to oversee and control the operation of the rig 200. The method 100 may also include positioning a reel skid at least partially vertically below the LER/DCR skid, as at 106. The reel skid may include one or more cable reels, e.g., control cable reels, power cable reels, etc. The reel skid and the LER/DCR skid may thus, when assembled, be connected together, e.g., so that power is provided to the LER/DCR skid via the power cables of the reel skid reels.

The installation of the combined LER/DCR skid and the reel skid is shown, according to an example, in FIGS. 4-9. It will be appreciated that several other skids may be installed before, during, or after installation of the LER/DCR skid. Beginning with FIG. 4, which is a plan view of the rig 200 at this stage, the substructure 201 includes a "driller's side" 400, which is opposite to an "off-driller's side" 402. The sides 400, 402 may generally be defined as the outward-facing sides of the base boxes 202, 204. The substructure 200 may also include a setback end 401 and a back end 403, which extend between the sides 400, 402.

Various skids and equipment may be positioned on the two sides 400, 402. For example, a combined skid frame 404 and a reel skid frame 406 are shown on the driller's side 400 in this view. Referring now to the side view of FIG. 5, there is shown the combined skid frame 404 being vertically above at least a portion of the reel skid frame 406. In order to achieve this arrangement, the skid frames 404, 406 may be moved into position from opposite ends 401, 403, e.g., the reel skid frame 406 may be brought in past the setback end 401 and the combined skid frame 404 may be brought in past the back end 403. In other embodiments, this could be swapped, or the frames 404, 406 could both be brought in from the same end.

Figure 5:
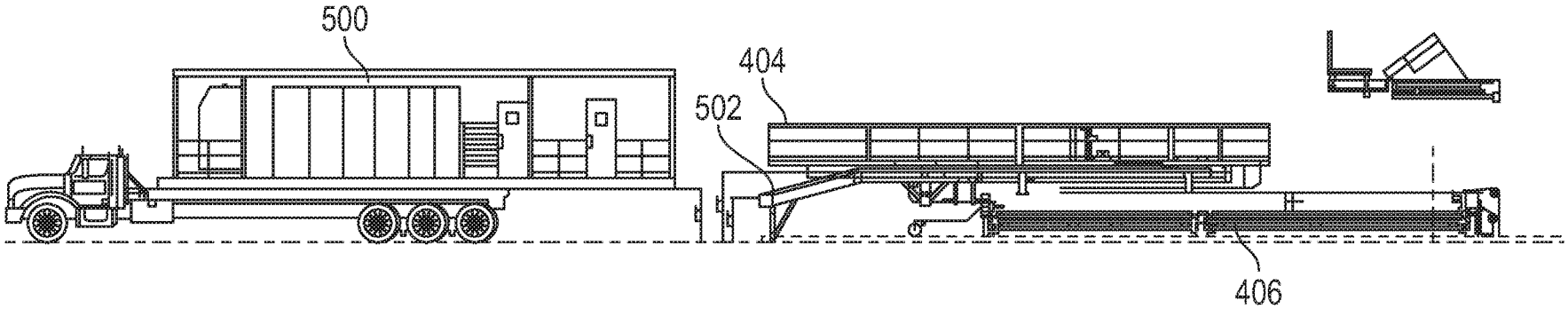
FIGS. 5 and 6 illustrates side views of a combined local equipment room (LER) and drilling control room (DCR) skid being positioned on the combined skid frame, according to an embodiment.
Figure 6:
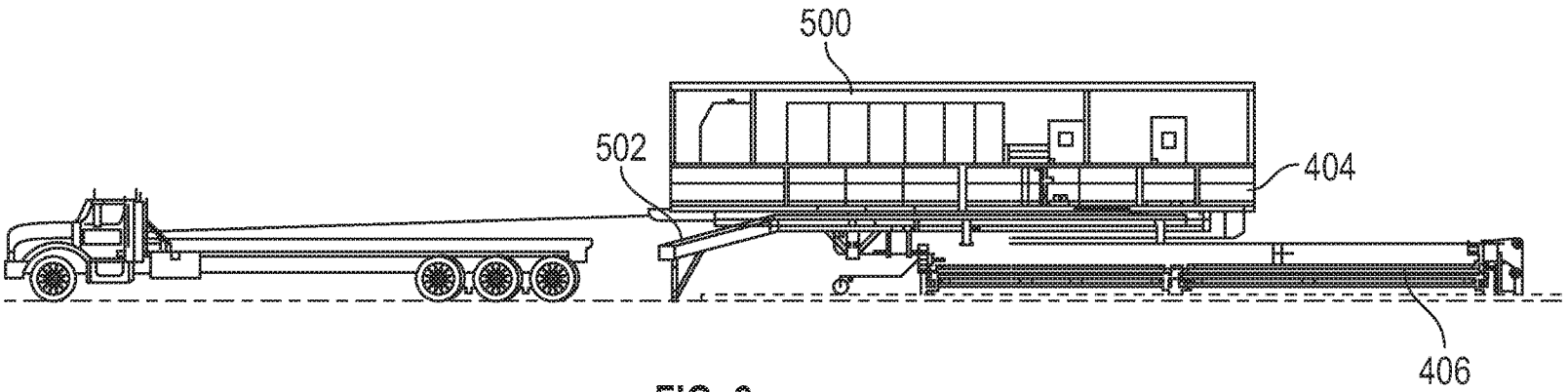

As shown in FIGS. 5 and 6, once the combined skid frame 404 is in place (this could be before or after the reel skid frame 406 is in place), a combined local equipment room and drilling control room (LER/DCR) skid 500 may be loaded onto the skid frame 404. In a specific example, the combined skid frame 404 may include a ramp 502, and the combined skid 500 may be pushed, pulled, rolled, or otherwise moved up the ramp 502 and onto the skid frame 404. The ramp 502 may extend toward the back end 403, in this embodiment.

Figure 7:
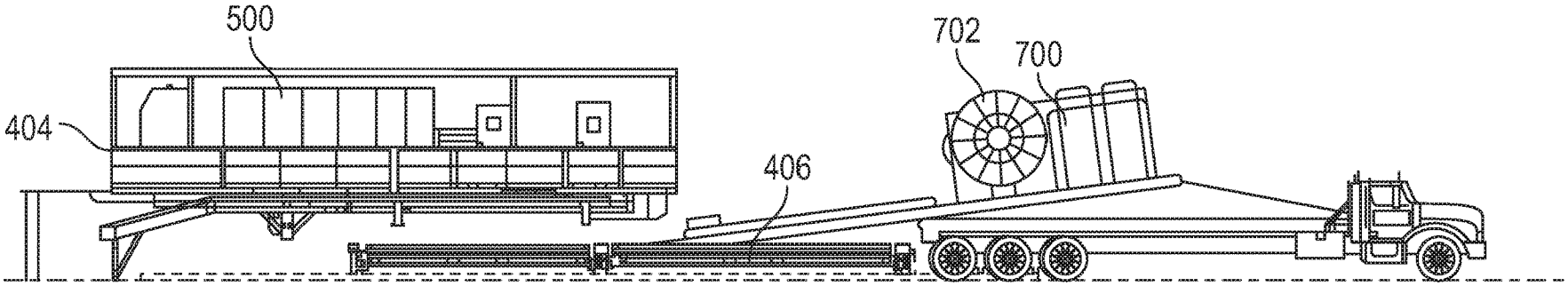
FIGS. 7 and 8 illustrates side views of a reel skid being positioned on a reel skid frame that is vertically below the combined skid frame, according to an embodiment.
Figure 8:
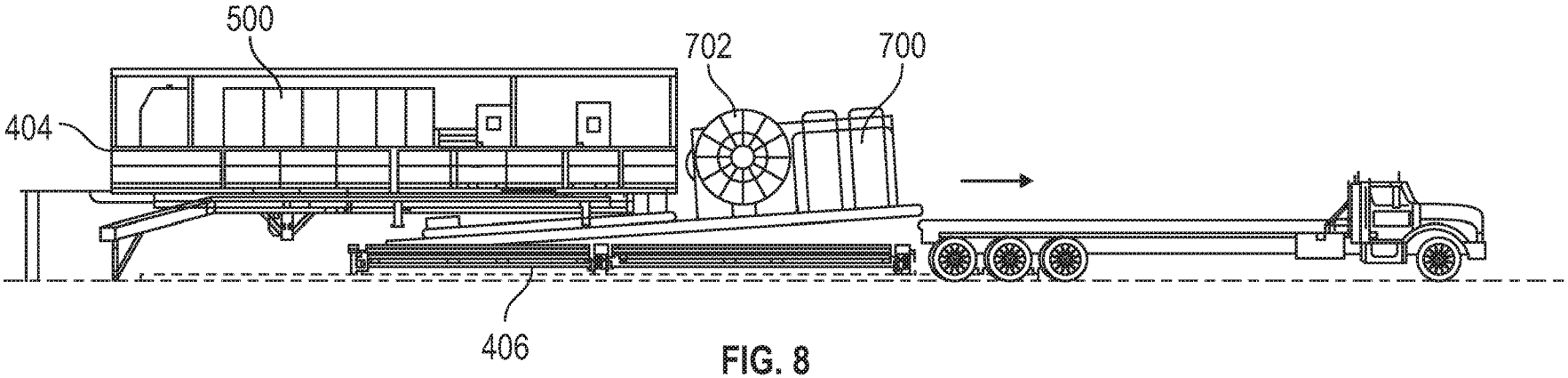
Figure 9:
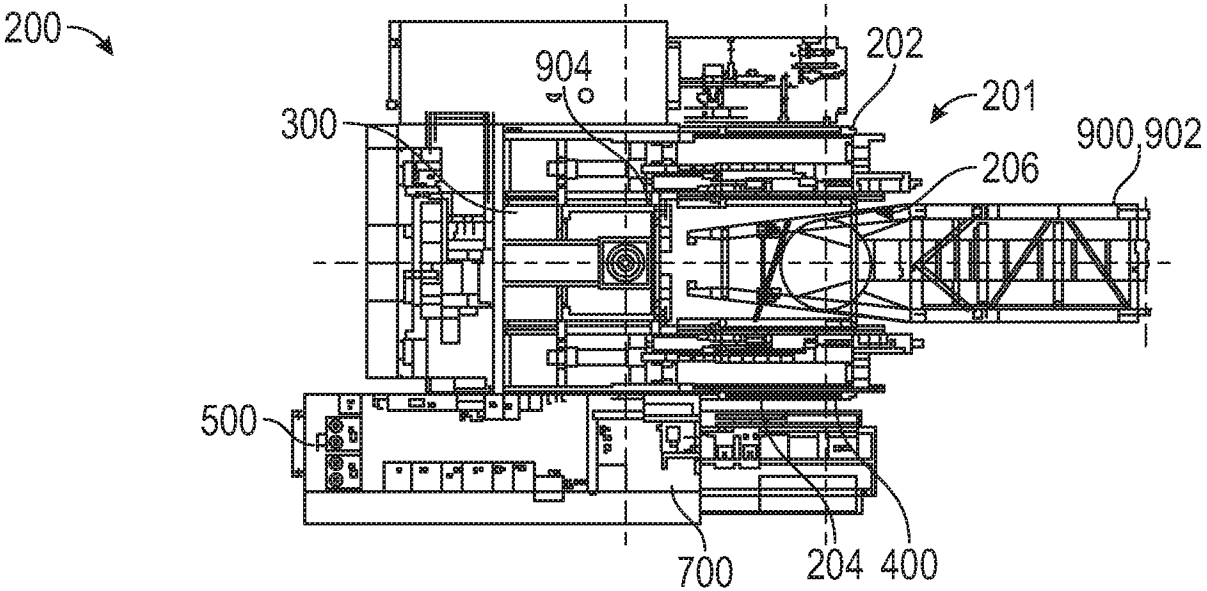
FIG. 9 illustrates a plan view of a mast section of the rig being connected to the rig floor, according to an embodiment.

Proceeding to FIGS. 7 and 8, a reel skid 700 may be loaded onto the combined skid frame 404 and/or the reel skid frame 406, e.g., by a truck proceeding from the direction of the setback side 402. The reel skid 700 may include one or more reels 702, as discussed above, which may hold control lines, power lines, etc. The reel skid 700 may be slid onto the reel skid frame 406, and partially under the combined skid frame 404, as shown. For example, the reel 702 may not be vertically below the combined skid frame 404. FIG. 9 illustrates a plan view of the rig 200 with the substructure 201 including the combined skid 500 positioned on the driller's side 400, with the reel skid 700 below and at least partially obscured from view.

Figure 10:
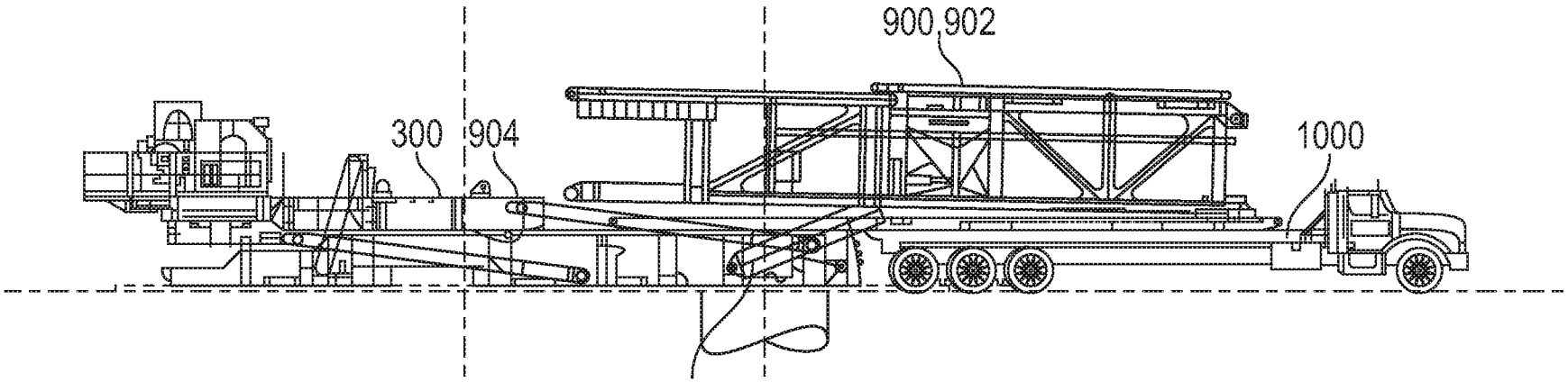
FIG. 10 illustrates a side view of the mast section of the rig being connected to the rig floor, according to an embodiment.

Returning to FIG. 1, the method 100 may proceed to receiving a mast section into the open space between the two base boxes, as at 108. Further, the mast section may be connected to the rig floor, as at 110. This is illustrated according to an embodiment in FIGS. 9 and 10. As shown, a lower section 900 of a mast 902 is received into the open space 206 between the base boxes 202, 204. For example, the lower section 900 is positioned on a truck trailer 1000, which is backed into proximity of the rig floor 300. The lower section 900 may then be attached to pivoting connections 904 on the rig floor 300.

One or more raising systems may then be engaged, such that the mast 902 may be raised at least partially to a vertical position, as at 112. For example, one or more mast and substructure raising cylinders (MSRC) 1002 may extend from either or both of the base boxes 202, 204 and connect to the mast section 900. The MSRC 1002 may then be extended so as to pivot the mast section 900 from the initial, generally horizontal position, to a raised, vertical position.

Figure 11:
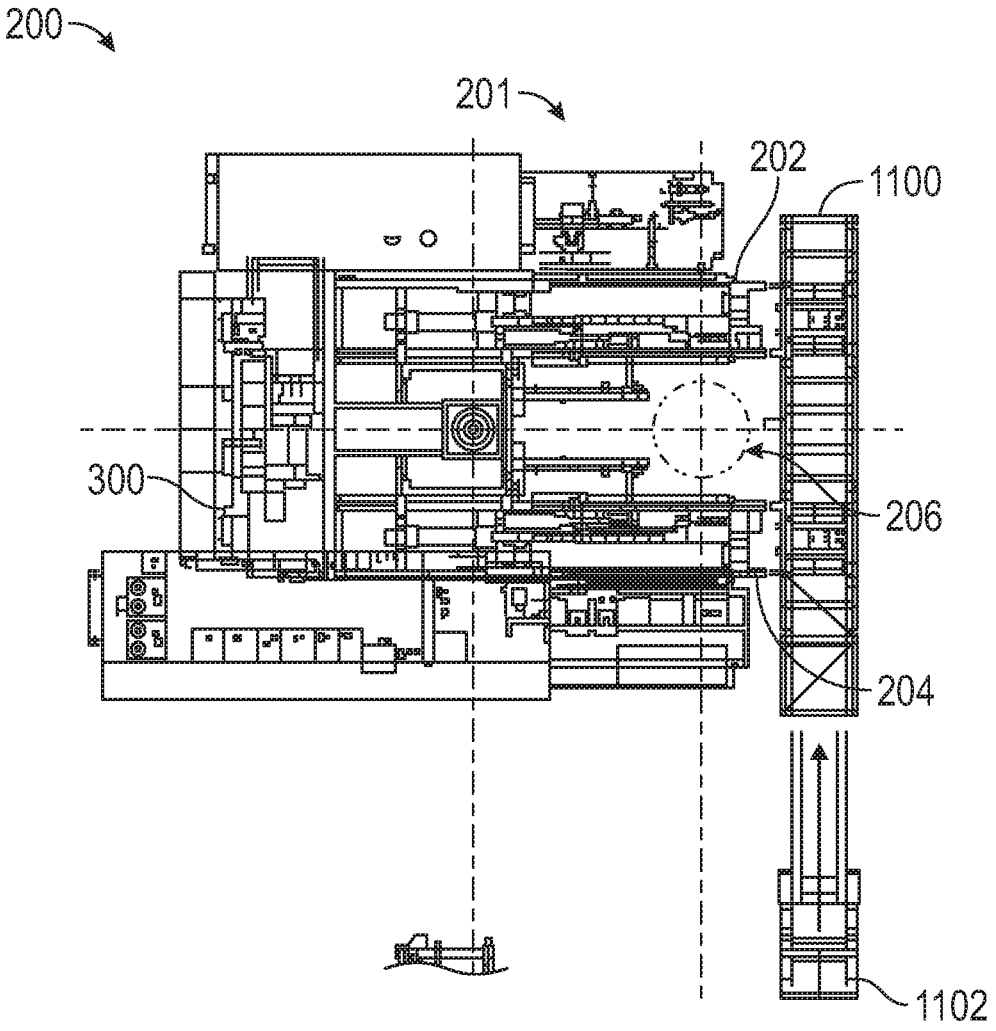
FIG. 11 illustrates a plan view of a setback structure being positioned across the open space between the first and second base boxes, according to an embodiment.

The method 100 may then include receiving a setback structure on the ground between the two base boxes, as at 114. FIG. 11 illustrates a plan view of a setback structure 1100 being received across the open space 206 between the base boxes 202, 204, according to an embodiment. Up to this point, in at least some embodiments of the method 100, the setback structure 1100 has not been present, leaving generally free access to the open space 206 and thus the rig floor 300 from the setback side 401. This allowed the mast section 900 to be received closely proximal to the rig floor 300, for connection thereto, as described above, with minimizing or allowing for the omission of a ramp for guiding the mast section 900 onto the rig floor 300. Further, the setback structure 1100 was not present to obstruct either of the skids 500, 700 or the corresponding frames 404, 406 to be received into position on the driller's side 400. At this point, however, with these structures in place, the setback structure 1100 may be received into position on the ground, e.g., using a truck 1102.

Figure 12:
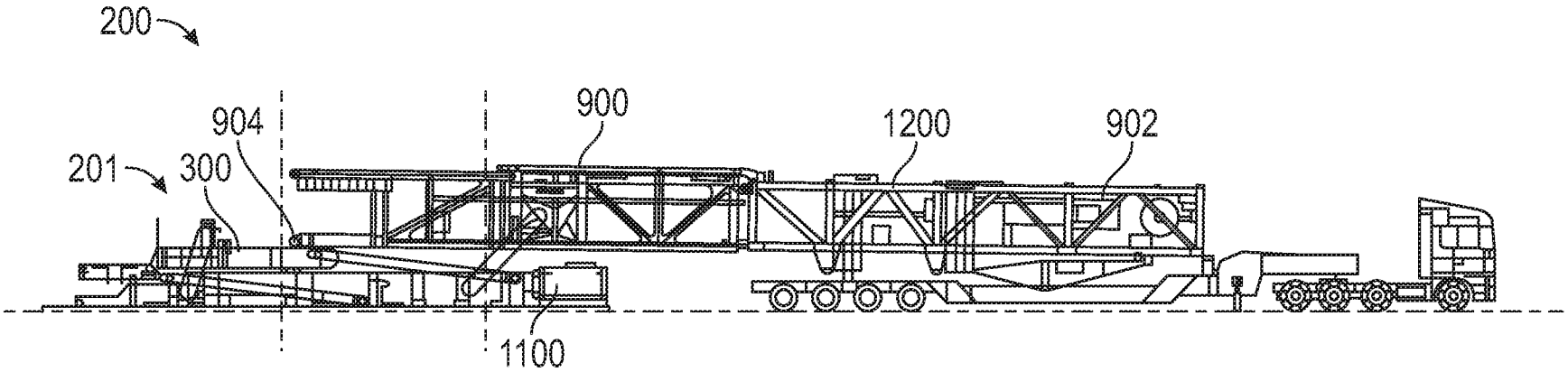
FIGS. 12 and 13 illustrate side views of a remainder of the mast being assembled to the mast section that is connected to the rig floor, according to an embodiment.
Figure 13:
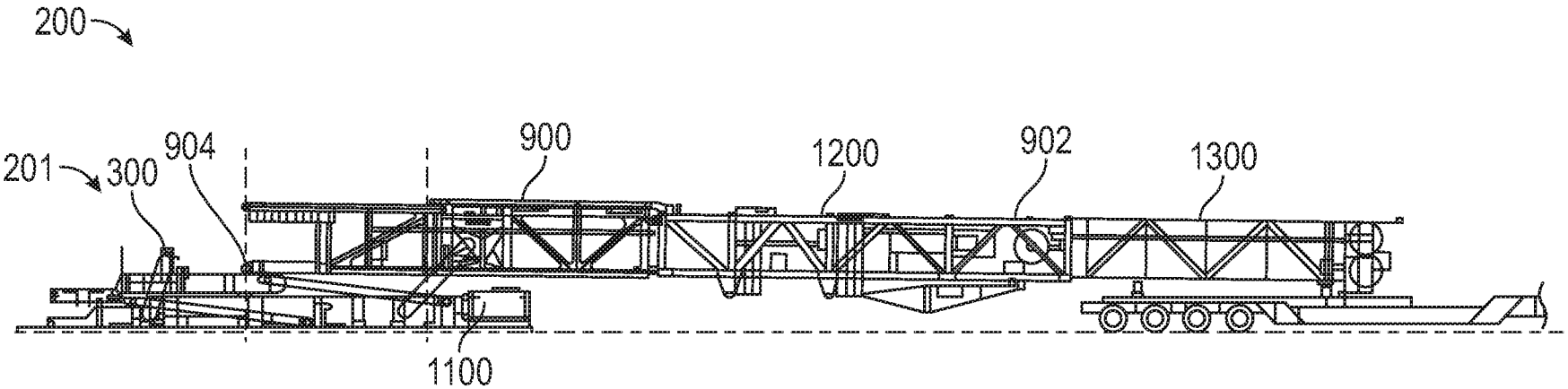

The method 100 may then proceed to lowering the mast section, as at 116, and connecting a remainder of the mast to the mast section that is connected to the rig floor, as at 118. As illustrated in FIG. 12, the mast section 900 may be lowered (i.e., pivoted to generally horizontal), and may, in at least some embodiments, extend horizontally past the setback structure 1100. Accordingly, a second mast section 1200 may be moved into position and connected to the mast section 900, without the setback structure 1100 obstructing the connection. As shown in FIG. 13, a third mast section 1300 may similarly be attached to the second mast section 1200, and so on until the mast 902 is fully constructed.

Figure 14:
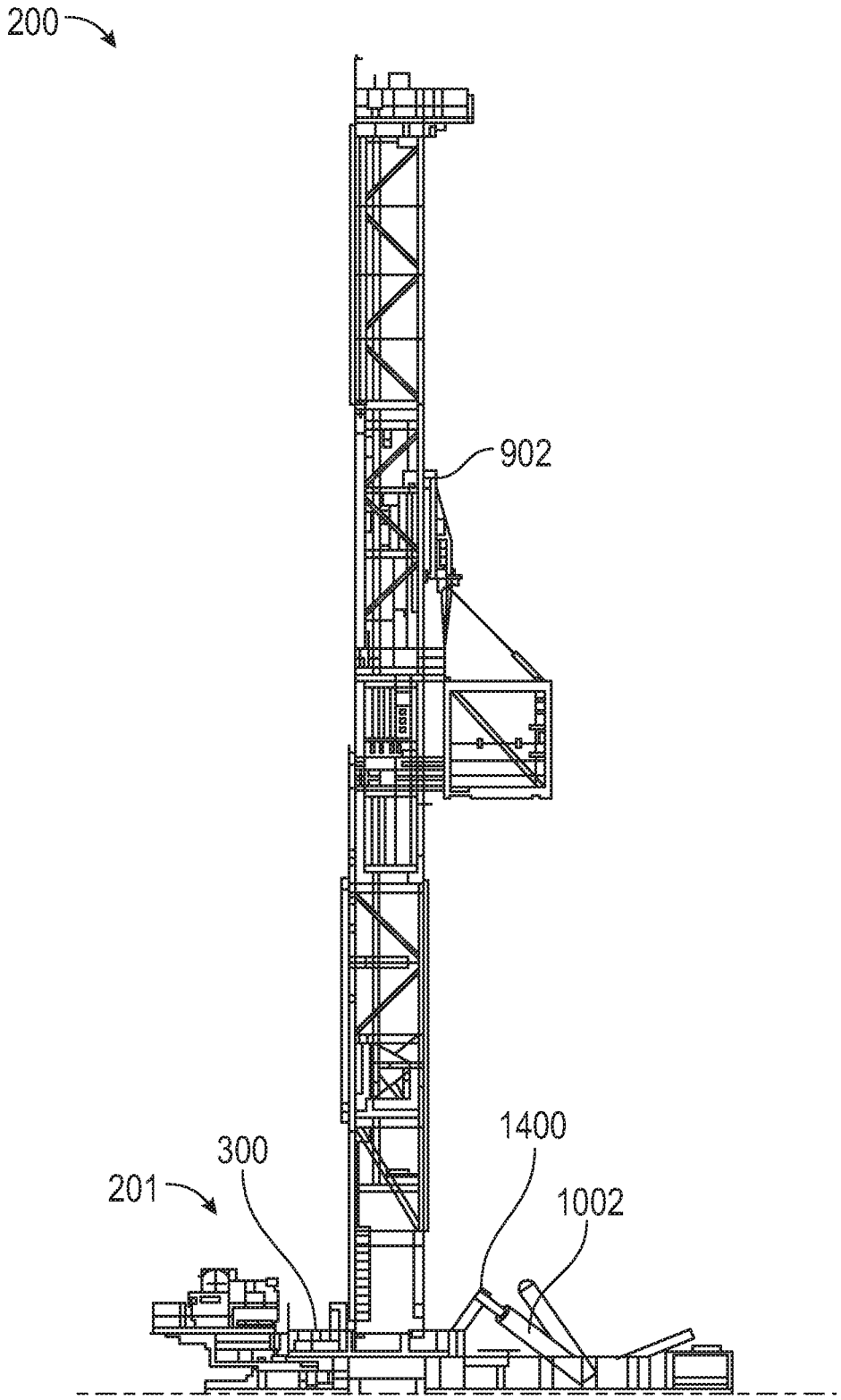
FIG. 14 illustrates a side view of the mast being raised, according to an embodiment.

The mast may then be raised, as at 120 of FIG. 1. FIG. 14 illustrates an embodiment of the rig 200 including the substructure 201 and the mast 902, with the mast 902 in a raised (vertical) position. The MSRC 1002, discussed above and shown in FIG. 14, may provide the driving force to raise the mast 902, e.g., by connection with the mast section 900.

Figure 15:
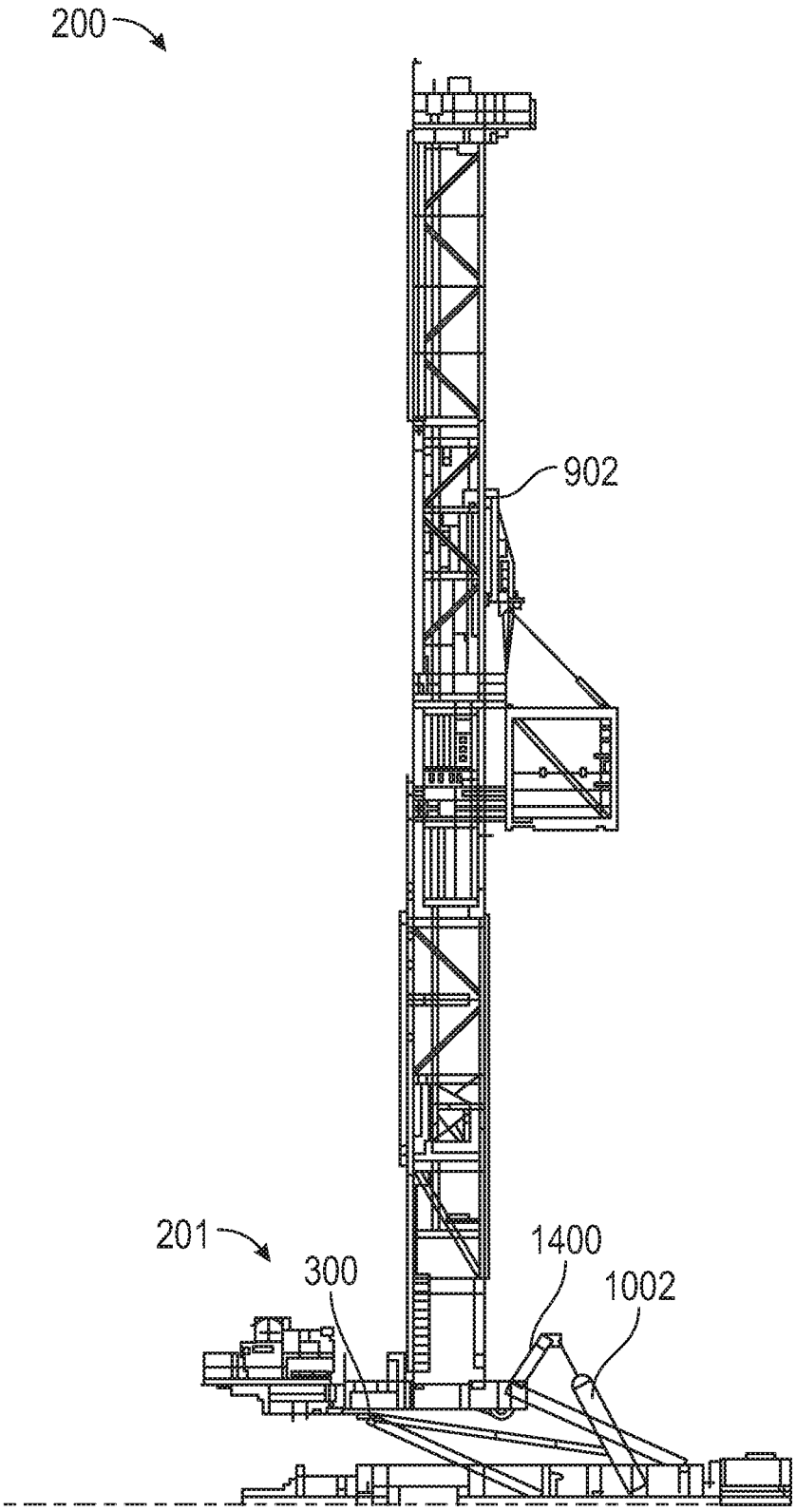
FIGS. 15 and 16 illustrates side views of the rig floor being raised, according to an embodiment.
Figure 16:
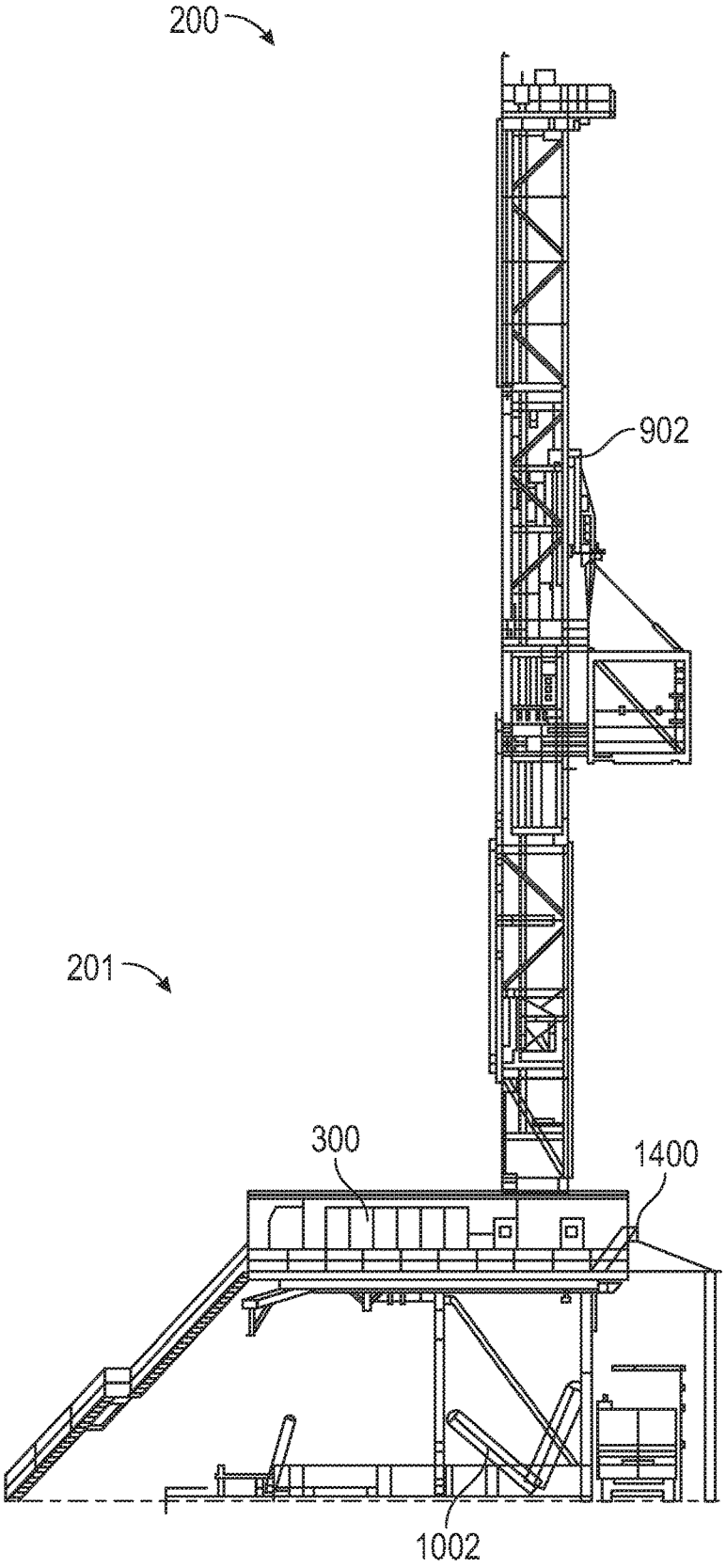

The rig floor including the combined LER/DCR skid may also be raised, as at 122. FIGS. 14 and 15 illustrate the rig floor 300 being raised. In an embodiment, the MSRC 1002 may be disconnected from the mast 902 and connected to a pivoting connector (e.g., a "horsehead") 1400 of the rig floor 300. The MSRC 1002 may then be extended, which may pivot the rig floor 300 and the mast 902 through an arc, upwards, to a raised position. As shown in FIG. 16, the horsehead 1400 may be disconnected from the MSRC 1002 and braced in position in the raised position.

Referring again to FIG. 1, in some embodiments, the rig 200 may be designed for batch or pad drilling, whereby the rig 200 may move or "walk" between nearby well sites. A variety of processes are known for moving the rig 200 over such short distances, including lift-and-slide techniques, rolling on the ground or on tracks, etc. In some cases, a well may be partially drilled, and equipment may be positioned at the top of the well. The rig 200 may then move to another wellsite to drill another well, while non-drilling activities (e.g., casing, cementing, etc.) are performed at the first well. The rig 200 may then be moved back to the first well, and the non-drilling activities may be performed on the second well. Accordingly, the rig 200 may be called upon to walk over/past the equipment at the partially-completed wells. However, the setback structure 1100 may be on the ground.

Figure 17:
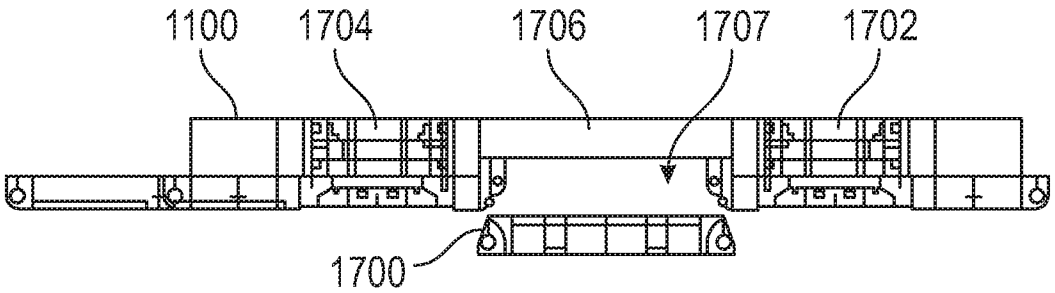
FIG. 17 illustrates a side view of the setback structure including a clearance panel, according to an embodiment.
Figure 18:
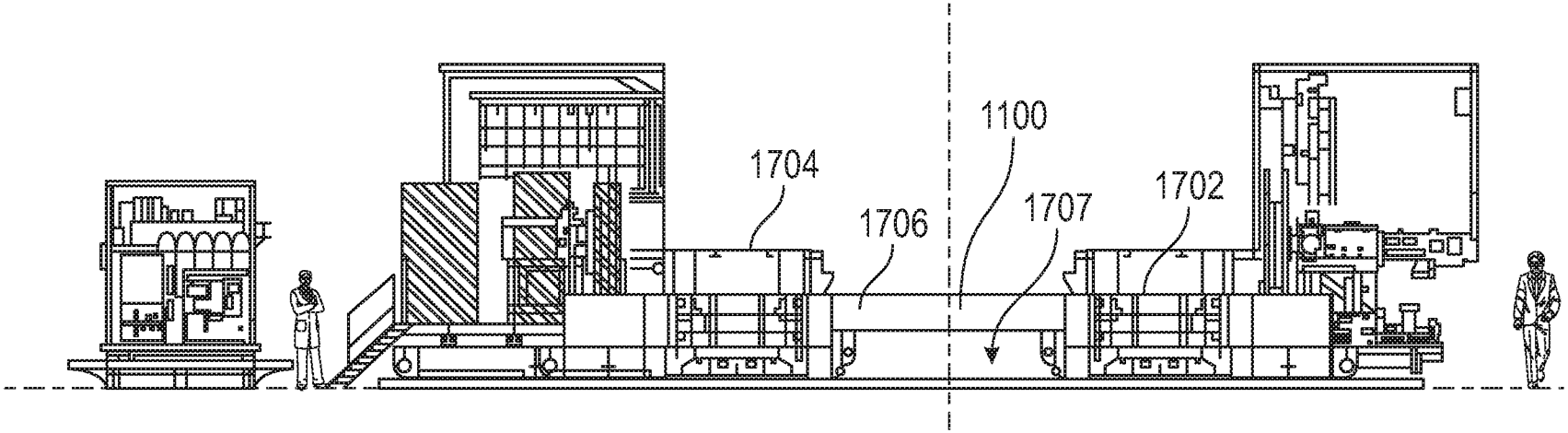
FIG. 18 illustrates a side view of the setback structure attached to the base boxes and with the clearance panel removed, according to an embodiment.

To clear the setback structure 1100, a clearance panel may be provided, which may be removed, as at 124 in FIG. 1. With the clearance panel removed, the rig 200 may walk between the wellsites, (also) as at 124. FIG. 17 illustrates a side, elevation view of the setback structure 1100 that includes such a clearance panel 1700, according to an embodiment. In the illustrated embodiment, the setback structure 1100 includes two end sections 1702, 1704, which may be connected to the base boxes 202, 204 (see, e.g., FIG. 11). A top bar 1706 may extend between the end sections 1702, 1704.

A clearance space 1707 is defined below the top bar 1706, and between the end sections 1702, 1704. The clearance panel 1700 may be configured to fit at least partially in the clearance space 1707, between the end sections 1702, 1704 and may be connectable thereto, e.g., using pins, bolts, etc. The clearance panel 1700 may be removable, movable while attached to the end sections 1702, 1704, or otherwise configured to be moved from between the end sections 1702, 1704. In a specific example, the clearance panel 1700 may be removed using a fork lift.

The top bar 1706 may remain rigidly connected to the end sections 1702, 1704, to ensure the end sections 1702, 1704 are not displaced relative to one another (which could make reattaching the clearance panel 1700 difficult, e.g., if the ground is not level). Further, the top bar 1706 may be spaced upward, such that the top bar 1706 is able to clear well equipment (e.g., by about 3 feet or more). Thus, once the clearance panel 1700 is removed, the setback structure 1100 is configured to clear the well equipment, allowing the rig 200 to move past the well equipment and into position. Once clear of the well equipment, the clearance panel 1700 may be once again connected to both the end sections 1702, 1704, e.g., providing rigidity and strength for the setback structure 1100. During drilling operations, pipe ends may be positioned in the setback structure 1100.

Figure 19:
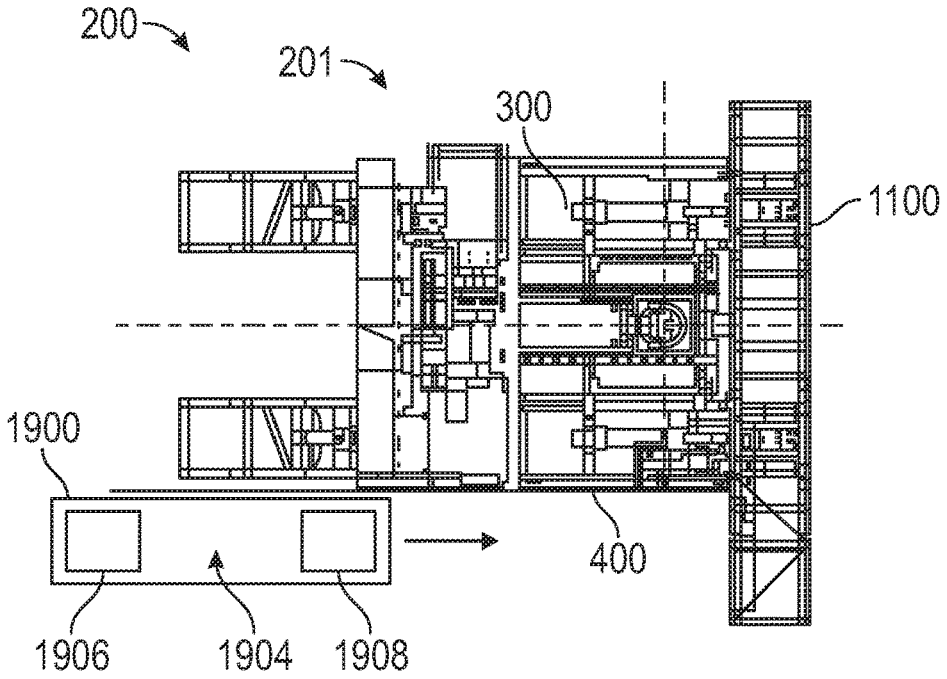
FIGS. 19, 20, and 21 illustrate plan views of another rig assembly process, according to an embodiment.
Figure 20:
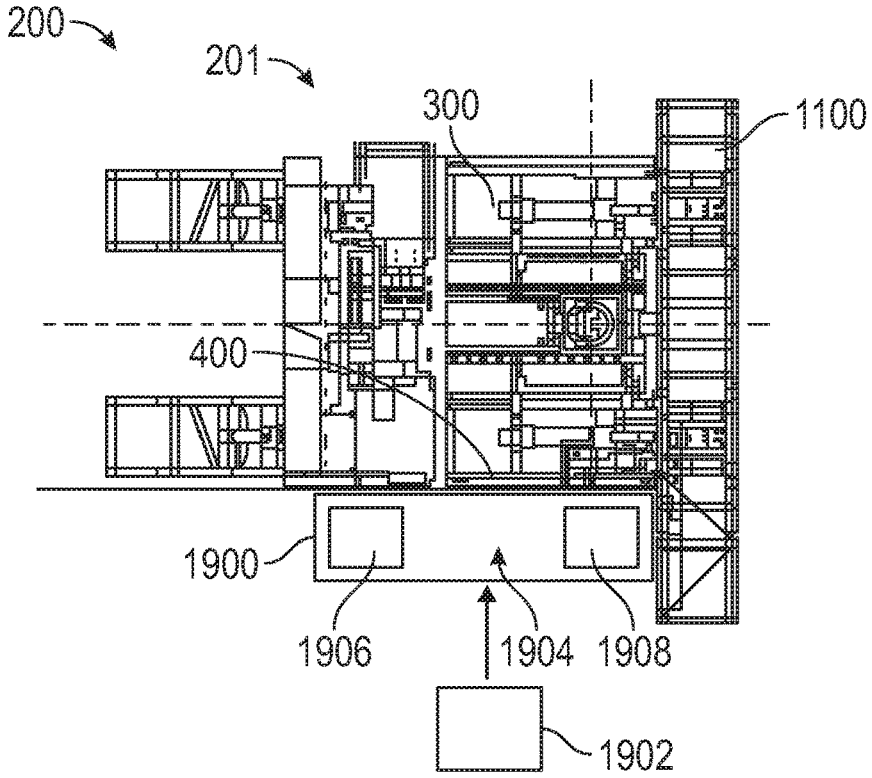
Figure 21:
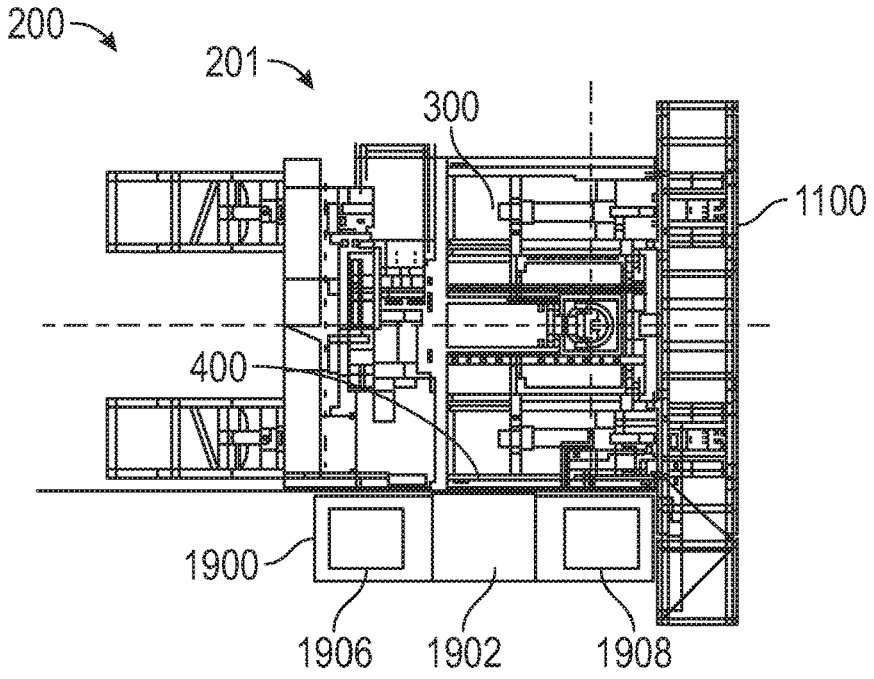

FIGS. 19-21 illustrate a plan view of the rig 200 during another embodiment of the rig-up sequence. In this embodiment, the setback structure 1100 may be on the ground, as shown in FIG. 19. A first skid 1900, which may be or include the local electronic equipment, reels, transformers, etc., may be positioned on the driller's side 400 of the rig 200, e.g., from the back side 401, as shown. As such, the first skid 1900 does not interfere with the setback structure 1100.

As shown in FIG. 20, a second skid 1902, which may be or include a driller's cabin, may then be brought into a space 1904 provided in the first skid 1900. For example, the space 1904 may be between two sets of equipment packages 1906, 1908. The second skid 1902 may be loaded onto the first skid 1900, in the space 1904, from a direction that is generally perpendicular to the driller's side 400, and generally parallel to the orientation of the setback structure 1100, as shown. As such, the second skid 1902 may also avoid interfering with the setback structure 1100.

Figure 22:
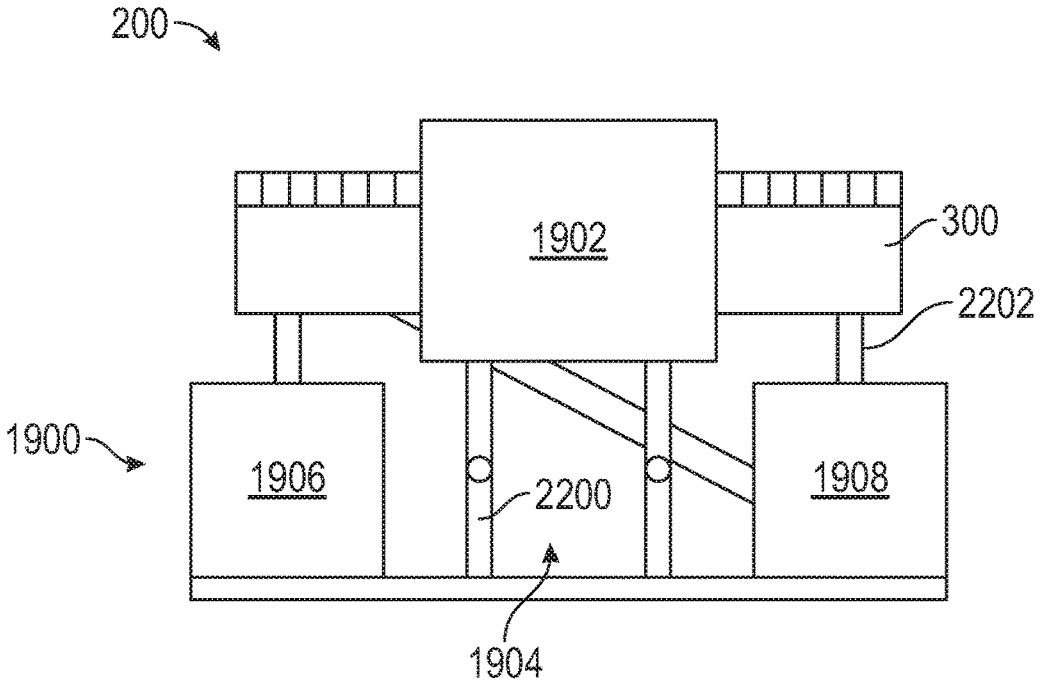
FIG. 22 illustrates a side, elevation view of the rig with the floor in an elevated position, according to an embodiment.

FIG. 21 illustrates the second skid 1902 having been loaded into the first skid 1900. The second skid 1902 may be connected to the rig floor 300, so as to be raised therewith, as shown in the elevation view of FIG. 22. Separate legs 2200 may be provided for the second skid 1900 (in addition to the substructure 201 legs 2202). The legs 220 may connect to the first skid 1900 or may be connected to another structure. Accordingly, the second skid 1902 may be raised with respect to the first skid 1900, from within the open space 1904 between the equipment packages 1906, 1908.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial configuration. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for assembling a drilling rig, comprising:

positioning a first base box of a substructure and a second base box of the substructure, such that the first and second base boxes are separated apart from one another by an open space;

connecting a rig floor between the first and second base boxes;

connecting a mast section to the rig floor;

after connecting the mast section to the rig floor, connecting a setback structure between the first and second base boxes and, after connecting the setback structure, lowering the mast section such that the mast section extends in a horizontal direction past the setback structure;

raising the rig floor such that the rig floor is vertically above the ground, wherein the setback structure is not raised with the rig floor; and after lowering the mast section, connecting a remainder of a mast to the mast section.

2. The method of claim 1, further comprising:

receiving the mast section in a substantially horizontal orientation into the open space between the first and second base boxes prior to connecting the mast section to the rig floor; and raising the mast section at least partially to a substantially vertical orientation after connecting the mast section to the rig floor and prior to connecting the setback structure between the first and second boxes.

3. The method of claim 1, further comprising:

before connecting the setback structure, receiving a first skid frame on a first side of the first base box past a setback end of the substructure, wherein the setback structure, when connected, is connected at the setback end; and receiving a second skid frame on the first side of the first base box past a back end of the sub structure.

4. The method of claim 3, wherein the second skid frame is vertically above at least a portion of the first skid frame.

5. The method of claim 4, further comprising connecting the second skid frame to the rig floor, such that the second skid frame is raised along with the rig floor.

6. The method of claim 5, further comprising:

positioning a reel skid on the first skid frame; and positioning a combined local equipment room (LER) and drilling control room (DCR) skid on the second skid frame.

7. The method of claim 3, further comprising:

receiving a first skid onto the first skid frame in a first direction; and receiving a second skid onto the second skid frame in a second direction that is opposite to the first direction.

8. The method of claim 1, further comprising:

removing a clearance panel from the setback structure; and moving the drilling rig past a wellsite, such that equipment at the wellsite is moved through a space left by the removal of the clearance panel.

9. A rig system, comprising:

a first base box;

a second base box extending parallel to and offset from the first base box, such that an open space is defined therebetween;

a rig floor connected to the first and second base boxes and spanning the open space;

a mast coupled to the rig floor; and a rig-raising system configured to raise the rig floor vertically above the ground;

a first skid connected to the rig floor and configured to be raised with the rig floor;

a second skid positioned at least partially vertically below the first skid; and a setback structure extending between the first and second base boxes and blocking the open space on at least one end;

wherein a mast section is configured to lower the mast section such that the mast section extends in a horizontal direction past the setback structure after connecting the setback structure and to connect a remainder of the mast to the mast section after lowering the mast section.

10. The rig system of claim 9, wherein the first skid comprises a combined local equipment room (LER) and drilling control room (DCR) skid, and wherein the second skid comprises a reel skid.

11. The rig system of claim 9, wherein the reel skid comprises one or more control cable reels, one or more power cable reels, or both, and wherein the combined LER and DCR skid comprises one or more variable frequency drives and a driller's cabin.

12. The rig system of claim 9, wherein the mast comprises a lower section and an upper section that are connected together, and wherein the lower section, when in a horizontal position, extends horizontally past the setback structure.

13. The rig system of claim 9, wherein the setback structure comprises:

a first end section connected to the first base box;

a second end section connected to the second base box; and a clearance panel connected to the first and second end sections, wherein the clearance panel is configured to be movable to allow for the setback structure to move past well equipment.

14. The rig system of claim 13, wherein the clearance panel is removable from the first and second end sections, and wherein the setback structure comprises a top bar that is rigidly connected to the first and second end sections both when the clearance panel is attached to the first and second end sections and when the clearance panel is removed therefrom.

15. The rig system of claim 9, wherein the reel skid and the combined LER and DCR skid extend parallel to one another.

16. A rig system, comprising:

a first base box;

a second base box extending parallel to and offset from the first base box, such that an open space is defined therebetween;

a rig floor connected to the first and second base boxes and spanning the open space;

a mast coupled to the rig floor, wherein the mast comprises a lower section and an upper section that are connected together;

a rig-raising system configured to raise the rig floor vertically above the ground;

a combined local equipment room (LER) and drilling control room (DCR) skid connected to the rig floor and configured to be raised with the rig floor, wherein the LER/DCR skid comprises one or more variable frequency drives and a driller's cabin;

a reel skid positioned at least partially vertically below the LER and DCR skid, wherein the reel skid comprises one or more control cable reels, one or more power cable reels, or both, and wherein the LER and DCR skid and the reel skid extend parallel to one another; and a setback structure extending between the first and second base boxes and blocking the open space on at least one end, wherein the setback structure comprises:

a first end section connected to the first base box;

a second end section connected to the second base box; and a clearance panel connected to the first and second end sections, wherein the clearance panel is configured to be movable to allow for the setback structure to move past well equipment, wherein the clearance panel is removable from the first and second end sections, and wherein the setback structure comprises a top bar that is rigidly connected to the first and second end sections both when the clearance panel is attached to the first and second end sections and when the clearance panel is removed therefrom.

17. The rig system of claim 16, wherein the lower section of the mast, when in a horizontal position, extends horizontally past the setback structure.

18. The rig system of claim 16, wherein a clearance space is defined below the top bar and between the first and second end sections, and wherein the clearance panel is configured to fit at least partially in the clearance space.

19. The rig system of claim 16, wherein the rig-raising system is configured to be connected to a pivoting connector of the rig floor, and wherein, when the rig-raising system extends, the pivoting connector enables the rig floor to pivot upwards through an arc.

* * * * *